US005202735A

United States Patent [19]

Thayer

[11] Patent Number: 5,202,735

[45] Date of Patent: Apr. 13, 1993

[54] METHOD TO CONTROL HOUSING AIR INLET GAP AND MEANS THEREFOR

[75] Inventor: Bruce E. Thayer, Webster, N.Y.

[73] Assignee: Xerox Corporation, Stamford, Conn.

[21] Appl. No.: 904,087

[22] Filed: Jun. 25, 1992

[51] Int. Cl.[5] ..... G03G 21/00

[52] U.S. Cl. ..... 355/298; 15/256.5; 355/215; 355/299; 355/301

[58] Field of Search ..... 15/1.51, 256.51, 256.5, 15/256.52; 355/215, 296, 297, 298, 299, 300, 301, 302, 303, 304, 305

[56] References Cited

U.S. PATENT DOCUMENTS

| | | | |
|---|---|---|---|
| 3,969,785 | 7/1976 | Ogawa et al. | 15/256.51 X |
| 3,986,233 | 10/1976 | Kieffer | 15/1.51 |
| 4,168,901 | 9/1979 | Ito et al. | 355/215 |
| 4,435,073 | 3/1984 | Miller | 355/298 X |
| 4,963,930 | 10/1990 | Yoshimaru et al. | 355/215 |

FOREIGN PATENT DOCUMENTS

| | | | |
|---|---|---|---|
| 55959 | 4/1983 | Japan | 355/297 |

OTHER PUBLICATIONS

Crooks, Electrophotographic Cleaning Apparatus, IBM Technical Disclosure, vol. 12 No. 11, Apr. 1970, p. 1819.

*Primary Examiner*—A. T. Grimley
*Assistant Examiner*—J. E. Barlow, Jr.
*Attorney, Agent, or Firm*—Oliff & Berridge

[57] ABSTRACT

A method and apparatus for controlling air inlet flow through a cleaner housing arranged downstream of a toner transfer area and adjacent an image forming surface of a photoreceptor in an electrophotographic machine. An adjustable air inlet baffle, with attached film seal, is mounted on the cleaner housing such that an air inlet gap is formed. The size of the gap and direction of air flow can be varied by the structure of the baffle. Additionally, the attached film seal extends laterally across, contacts and rests upon the image forming surface of the photoreceptor, thus allowing the photoreceptor to pass under the film seal unobstructed while the film seal acts in sealing engagement with the photoreceptor to prevent emissions of residual toner from the housing.

17 Claims, 2 Drawing Sheets

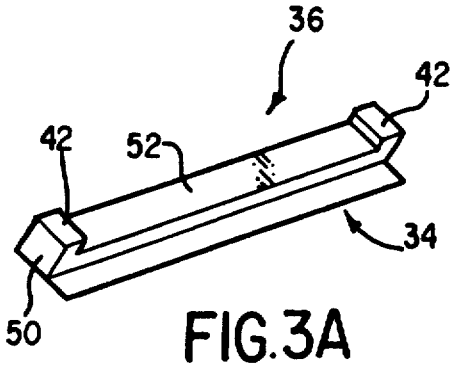
FIG.3A
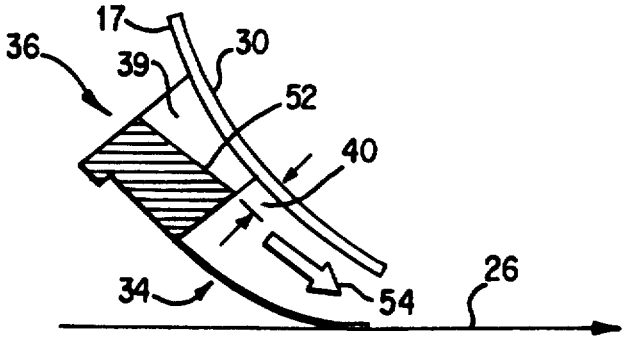
FIG.3B
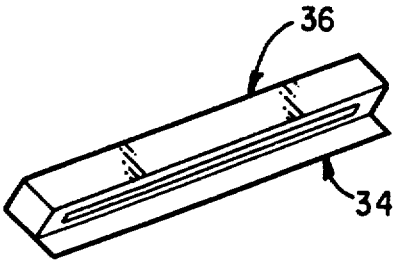
FIG.4A
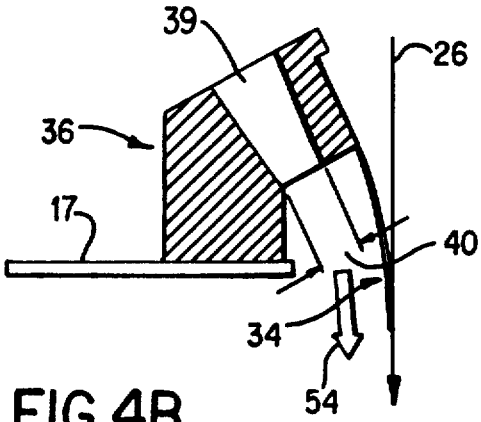
FIG.4B
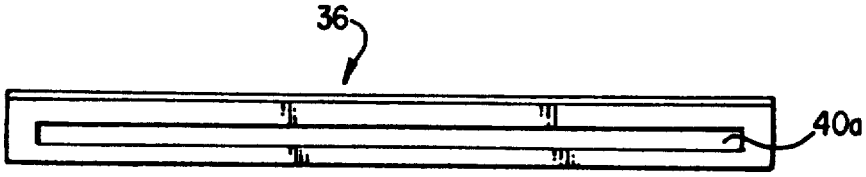
FIG.5
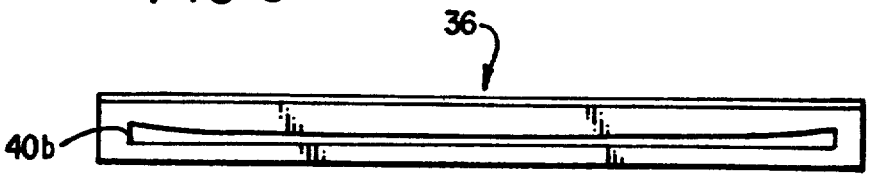
FIG.6
FIG.7
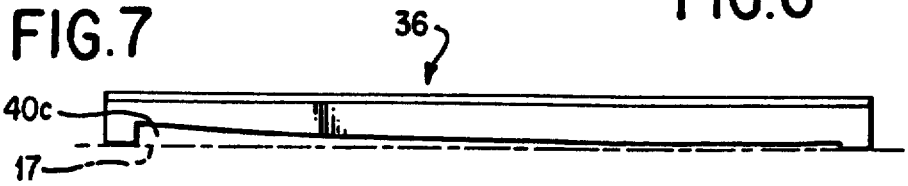

METHOD TO CONTROL HOUSING AIR INLET GAP AND MEANS THEREFOR

BACKGROUND OF THE INVENTION

1. Field of the Invention

This invention relates to an electrophotographic image forming apparatus, and more particularly to cleaning devices for removing residual toner and debris from a charge retentive surface of an image forming apparatus.

2. Description of Related Art

Typical cleaning methods in electrophotographic applications such as xerography, include a method to clean the charge retentive surface of an image forming apparatus by wiping with a fur brush, a web, a blade and the like, a method to clean by using magnetism or a magnetic brush, a method to clean by using an air current and/or a combination of at least several of the above. Cleaning methods employing an air current, either in combination with a brush, brush and blade or multiple blades are most preferred for use with the apparatus described herein.

The control of inlet air flow is essential for cleaning devices which use air flow through the cleaner housing. Cleaner housings may have upstream and downstream air inlets, such as electrostatic brush cleaners, for instance, and must balance the air flows from the two sides of the housing. This is typically done by controlling the cleaner housing spacing to the photoreceptor, the spacing between the brush and the cleaner housing inner wall and/or by adding interferences between the brush and the cleaner housing inner wall near the air inlet to create a pressure situation which will affect the air flow. All of these air flow control methods are effective to some degree.

Each, however, requires extremely close tolerances to maintain the spacings and interferences which are essential for the methods to function as desired. Further, there are generally a large number of parts which must be taken into account to determine the total tolerance stackup for the spacings and interferences. Some parts, such as the electrostatic brush, cannot be held to very tight tolerances and have poor environmental and age stability. Other parts, such as a cleaner housing assembly, can be manufactured to a moderate tolerance but, because other portions of the part must also be held to a critical location(s), the tolerance at the air inlet is compromised by the competing function(s). This problem may occur in many types of cleaner housings situated against the photoreceptor with active or passive air flow and used to control toner or other effluent emissions.

Additionally, toner emissions have been controlled on some blade cleaner housings by use of an upstream film seal riding on the photoreceptor surface. These seals prevent toner clouds, formed at the tip of the cleaning blade, from escaping the cleaner housing. No detrimental affects are caused by these film seals riding on a photoreceptor surface unless an untransferred toner image would be disturbed.

SUMMARY OF THE INVENTION

It is thus an object of the invention to obviate the foregoing drawbacks of the prior art by providing an improved method and apparatus for controlling the housing air inlet gap between a cleaner housing and a photoreceptor surface.

Another object of the invention is to provide an improved apparatus and method for controlling the housing air inlet gap between a cleaner housing and a photoreceptor surface that avoids stringent manufacturer's settings and high tolerance requirements for multiple components, allows the use of intentionally non-uniform air gaps if desired and reduces part and assembly costs.

These and other objects and advantages are obtained by the inventive method and apparatus for controlling air inlet flow. The method and apparatus includes a cleaner housing arranged downstream of a toner transfer area and adjacent an image forming surface of a photoreceptor in an electrophotographic apparatus, a means for controlling air inlet flow includes an air inlet baffle removably attached to the housing which results in an air inlet gap being formed between the housing and the baffle main body, such that gap spacing, and thus air flow volume and force, is a function of the baffle gap dimensions relative to the housing, and attaching a film seal to the baffle which extends laterally across, contacts and rests upon the image forming surface allowing the image forming surface to pass underneath unobstructed while acting in sealing engagement with the image forming surface to prevent emissions of residual toner from the housing. Alternatively, the air inlet baffle attached to the housing may include a predimensioned air inlet gap disposed in a central portion of the baffle.

Other objects, advantages and salient features of the invention will become apparent from the detailed description, which taken in conjunction with the annexed drawings, discloses preferred embodiments of the invention.

BRIEF DESCRIPTION OF THE DRAWINGS

Referring now to the drawings which form part of this original disclosure:

FIGS. 3A and 3B are a schematic elevational view depicting a first embodiment of the invention and its mounting to a cleaner housing respectively;

FIGS. 4A and 4B are a schematic elevational view depicting an alternative embodiment of the invention and its mounting to a cleaner housing respectively; and FIGS. 5–7 are schematic end views of air inlet baffles showing the variations in the air inlet gap.

DETAILED DESCRIPTION OF THE PREFERRED EMBODIMENTS

Figure 2:
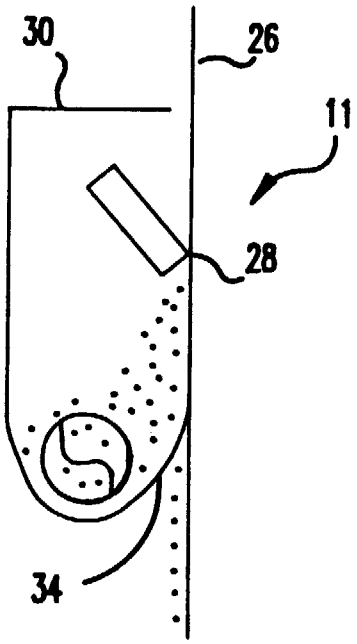
FIG. 2 PRIOR ART
FIG. 2 is a schmatic plan view of a prior art cleaner housing incorporating a blade cleaning method.

The method and apparatus for improving cleaning efficiency of air current cleaners used for cleaning a charge retentive surface of a moving photoreceptor will be described in combination with a particular copier or xerographic device that uses a photoreceptor having a change retentive surface. However, the method and apparatus to control the cleaner housing air inlet gap may be used with any printing apparatus that includes a charge retentive surface and a cleaning method that includes an air current. The present invention is particularly applicable to any printer containing a charge retentive surface which is subject to the retention of toner particles thereon.

For a general understanding of the features of the present invention, reference is made to the drawings. In the drawings, like reference numerals have been used throughout to designate identical elements.

Air inlet gaps between a cleaner housing and a photoreceptor surface can be controlled firstly, by sealing the housing/photoreceptor gap with a film seal and secondly by forming a controlled air gap with an air inlet baffle mounted to the outside surface of the cleaner housing. This eliminates many high tolerance requirements and allows the use of intentionally non-uniform air gaps if desired. This invention is particularly applicable to cleaner housings and will avoid stringent manufacturer's settings and reduce part and assembly costs.

Figure 1:
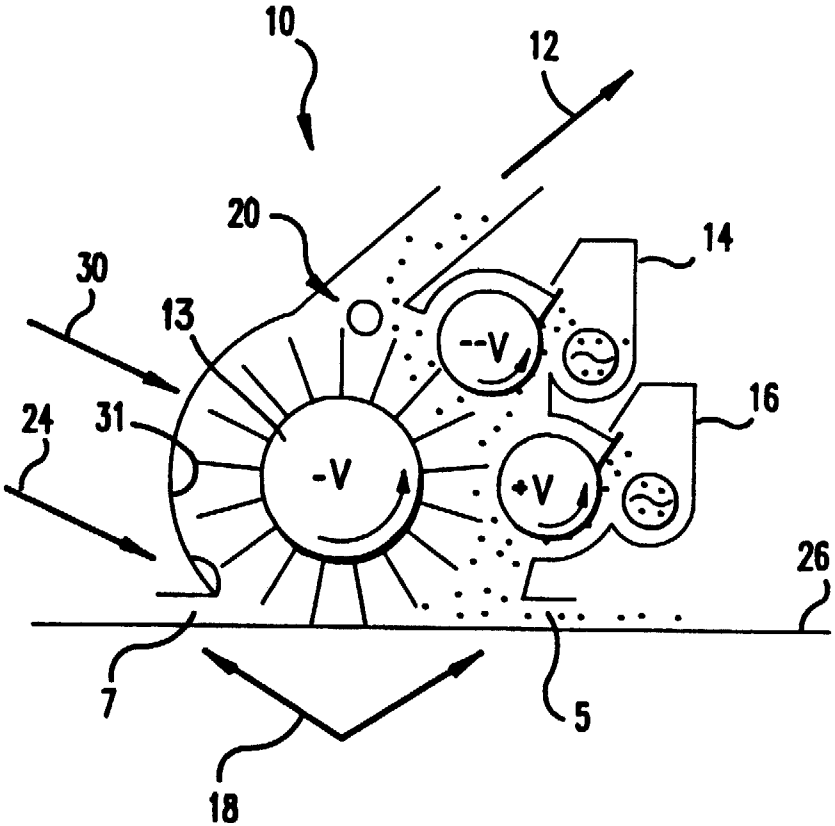
FIG. 1 PRIOR ART
FIG. 1 is a schematic plan view of a prior art cleaner housing incorporating a blade cleaning method.

The control of air inlet flow, as stated previously, is a must for cleaners which use air flow through the cleaner housing. Turning now to FIG. 1, cleaner housings 30 which have upstream and downstream air inlets 5, 7, such as electrostatic brush (ESB) cleaners 10, must balance the air flows from the two sides of the housing 30. This is normally done by controlling the cleaner housing 30 spacing to the photoreceptor 26, the spacing generally indicated at 18, controlling the spacing between the brush 13 and the cleaner housing inner wall 31 and/or adding interferences 24 between the brush 13 and the cleaner housing inner wall 31 near the downstream air inlet 7 to create a pressure situation which will affect the air flow (air flow direction indicated at arrow 12). All of the above mentioned air flow control methods are effective to some degree. However, each requires extremely close tolerances to maintain the spacings and interferences, which are essential for the methods to function as desired. Additionally, there are a large number of parts which must be taken into account to determine the total tolerance stack-up for the spacings and interferences. Some parts, such as the electrostatic brush 13, cannot be held to very tight tolerances and have poor environmental and age stability. Other parts, such as the cleaner housing assembly 30, can be manufactured to a moderate tolerance but because other portions of the assembly must be held to critical locations, the tolerance at the air inlets 5, 7 is sacrificed for the competing functions. This type of problem can occur in many types of cleaner housings situated against a photoreceptor 26 with active or passive air flow used to control toner or other effluent emissions.

Toner emissions have been controlled in some prior art blade cleaner housings, shown generally in FIG. 2 at 11 with the cleaner housing indicated at 30, by the use of an upstream film seal 34 riding on the photoreceptor surface 26. These seals 34 prevent toner clouds formed at the tip of a cleaning blade 28 from escaping the cleaner housing 30. No detrimental affects are usually encountered by use of these film seals 34 riding on the photoreceptor surface 26.

Turning now to FIGS. 3-7, the invention is depicted and includes a cleaner housing 30 arranged downstream of a toner transfer area (not shown) and adjacent an image forming surface of a photoreceptor 26 in an electrophotographic apparatus (not shown). A means for controlling air inlet flow volume and direction through the cleaner housing 30 includes an air inlet baffle 36 removably attached to the housing outside surface 17 and a film seal 34 fixedly attached to the baffle 36 which extends laterally across, contacts and rests upon the image forming surface 26 allowing the image forming surface 26 to pass unobstructed past the film seal 34 while the film seal 34 acts in sealing engagement with the image forming surface 26 to prevent emissions of residual toner (not shown) from the cleaner housing 30. The baffle 36 is removably attached to the housing outside surface 17 by at least two mounting screws (not shown). The baffle 36 has an elongated center section, or main baffle body, 52 with a mounting section 50 at each end. The height of each of the mounting sections 50 defines the size of the air gap (FIG. 3A). A mounting screw passes through each mounting section 50 to affix the baffle 36 to the cleaner housing 30. The baffle 36 is constructed of a suitable resin material and the film seal 34 is constructed of an elastomeric material. Additionally, spacers (not shown) of rubber, cork, or a similar material, can be placed between the mounting sections 50 and the cleaner housing 30 to adjust the air gap and to provide a seal.

The air inlet gap 40 is formed between the housing outside surface 17 and the main baffle body 52 when the baffle 36 is attached to the housing outside surface 17. The shape of the main baffle body 52 and the height of the mounting sections 50 determine the size, shape and angle of the air inlet spacing 39 and, therefore, the volume and force of air inlet flow 54.

Alternatively, in a second embodiment, see FIGS. 4A and 4B, the air inlet baffle 36 attached to the housing outside surface 17 includes a predimensioned air inlet gap 40 disposed in a central portion of the baffle 36. The location of the air inlet gap 40 and its configuration control the volume and force of air inlet flow 54. To change the flow volume or force requires an exchange of the air inlet baffle 36.

FIGS. 5-7 show possible variations in air inlet gaps 40 that change the air flow pattern to obtain the best collection of toner particles for a particular electrophotographic cleaning device, with FIGS. 5 and 6 showing the variations in the context of the second embodiment of the air inlet baffle 36, and FIG. 7 showing the gap in the context of the first embodiment. However, the shown gaps are suitable to either embodiment. In FIG. 5, a uniform air flow gap 40*a* is shown. In FIG. 6, a gap with a taper 40*b* to increase air flow at the ends is shown, and in FIG. 7, a gap with inboard/outboard taper 40*c* against housing outside surface 17 is shown.

The tolerances associated with forming the air inlet gap 40 can be more easily controlled because the spacing tolerances are set within the mounting of one part, the air inlet baffle 36, that is manufactured to predetermined size. Further, the film seal 34 provides a self spacing seal to the photoreceptor 26 which can easily take up any tolerance variation between the photoreceptor 26 and the housing outside surface 17. Thus, the air flow into the housing 30 can be controlled better and without the need for numerous high tolerance and high cost parts. This method and apparatus can be used for any housing 30 positioned adjacent a photoreceptor 26 to control air inlet flow 54 if the rubbing of the film seal 34 on the photoreceptor 26 does not cause a problem (e.g., cannot be used where an untransferred toner image would be disturbed).

The inventive concept described herein has application to any cleaning means for an electrophotographic apparatus utilizing an air current for cleaning. Use of the invention to control cleaner housing air inlet gap, and therefore air flow, is simple and cost effective. The inventive concept has application to cleaning means requiring good control of the air flow along an entire width of the cleaner housing and, therefore, cleaning means requiring uniform air flow to all areas of the brush and/or the following blade are acceptable uses for the disclosed invention. Additionally, cleaning means that draw air from the ends of the cleaner housing and, therefore, have a non-uniform air flow distribution can be accommodated as well.

While the present invention has been described in connection with the preferred embodiments, it will be understood that it is not intended to limit the invention to these embodiments. On the contrary, it is intended to cover all alternatives, modifications and equivalents as may be included within the spirit and scope of the invention as defined by the appended claims.

What is claimed is:

1. In an electrophotographic apparatus, an improved cleaning means for removing residual toner from the image forming surface of a moving photoreceptor, said cleaning means employing an air current, comprising:

a cleaner housing arranged adjacent said image forming surface of said photoreceptor;

a means for controlling air inlet flow volume and direction through said cleaner housing including:

an air inlet baffle removably attached to said housing; and a film seal fixedly attached to said air inlet baffle which extends laterally across, contacts and rests upon said image forming surface, allowing said image forming surface to pass unobstructed beneath said film seal while acting in sealing engagement with said image forming surface to prevent emissions of said residual toner from said housing.

2. The apparatus of claim 1, wherein said air inlet baffle is removably attached to said cleaner housing by mounting means.

3. The apparatus of claim 1, wherein said air inlet baffle further comprises two mounting sections molded to a main body of said baffle and disposed at opposite ends of said baffle main body.

4. The apparatus of claim 3, wherein an air inlet gap is formed between said housing and a main body of said air inlet baffle when said air inlet baffle is attached to said housing.

5. The apparatus of claim 4, wherein said gap is varied by the structure of said air inlet baffle.

6. The apparatus of claim 1, wherein said air inlet baffle further comprises an air inlet gap which is disposed in a central portion of said air inlet baffle.

7. The apparatus of claim 1, wherein said air inlet baffle is made of a resin material.

8. The apparatus of claim 1, wherein said film seal is made of an elastomeric material.

9. The apparatus of claim 1, wherein said housing further comprises an electrostatic brush cleaner assembly.

10. The apparatus of claim 1, wherein said housing further comprises a blade cleaning assembly.

11. The apparatus of claim 1, wherein said housing further comprises a multiple-blade cleaner assembly.

12. The apparatus of claim 1, wherein said housing further comprises a combined cleaner assembly comprising both a plurality of blades and an upstream disturber brush.

13. A method of controlling air inlet flow through a cleaner housing located adjacent an image forming surface of a photoreceptor in an electrophotographic apparatus which comprises the steps of:

regulating air flow volume and force by providing an air inlet gap by attaching an air inlet baffle removably to said housing; and sealingly engaging said image forming surface to prevent emissions of residual toner from said housing by attaching a film seal fixedly to said baffle which extends laterally across, contacts and rests upon said image forming surface, allowing said image forming surface to pass unobstructed beneath said film seal.

14. The method according to claim 13, wherein said air inlet baffle is removably attached to said cleaner housing by mounting means.

15. The method according to claim 13, wherein said air inlet baffle comprises two mounting sections molded to a main body of said baffle and disposed at opposite ends of said baffle main body.

16. The method according to claim 15, wherein said air inlet gap is formed between said housing and said baffle main body when said baffle is attached to said housing.

17. The method according to claim 16, further comprising the step of varying a size of the air inlet gap by placing spacers between said mounting sections and the cleaner housing.

* * * * *